United States Patent [19]

Cvacho

[11] 4,301,940

[45] Nov. 24, 1981

[54] EASY OPEN CAN END CONSTRUCTION

[76] Inventor: Daniel S. Cvacho, 241 Kirkley Cir., Forest, Va. 24551

[21] Appl. No.: 172,177

[22] Filed: Jul. 25, 1980

[51] Int. Cl.[3] ..... B65D 17/34

[52] U.S. Cl. ..... 220/269; 220/274

[58] Field of Search ..... 220/269–273, 220/258, 274

[56] References Cited

U.S. PATENT DOCUMENTS 3,204,805 9/1965 May ..... 220/258 X 3,970,212 7/1976 Brown ..... 220/269

*Primary Examiner*—George T. Hall

*Attorney, Agent, or Firm*—Richard P. Matthews

[57] ABSTRACT

An easy open can end construction and method of making it. The pull tab and tear strip remain fully locked onto the can end, and the opening strip does not dip into the beverage. Bead members positioned externally of the tear strip not only preserve a desired orientation of the pull tab with respect to the tear strip but also serve as a guard against the user's face or tongue contacting the raw edge left after lifting the tear strip. The tear strip itself is provided with one or more protective pads to protect the user's face. A sanitary cover member overlies the tear strip and is rolled up with the pull tab and tear strip becoming interlocked therewith. A method of making the score line pattern is included so that tearing occurs along a single side of the bottom of the score line pattern to avoid a zigzag tear pattern which is dangerous to the user's tongue or lips. Finally, a method of making a rivet is included in which two metal thicknesses are joined together to avoid a leaking problem encountered in single metal thickness rivets.

20 Claims, 19 Drawing Figures

EASY OPEN CAN END CONSTRUCTION

This invention relates to an easy open can end construction and method of making same and, more particularly, to such a construction and method of making wherein the pull tab remains locked into the container.

BACKGROUND OF THE INVENTION

Heretofore it has been known to provide easy open can ends with pull tabs which remain affixed to the can. At the present time, most easy open can ends are of the so-called "push in" type where a portion of the can end is pushed downwardly into the liquid contents of the can. The U.S. Pat. Nos. issued to Cudzik, namely 3,967,750; 3,967,752 and 3,967,753 are illustrative of this type of can end construction. The principal objection to this type is a lack of cleanliness in that the portion of the can end that is pushed into the liquid contents may contain dust, dirt or other contaminants that are directly introduced into the beverage.

A second general type of problem illustrated in much of the prior art patents is the failure to maintain control of the final position of the tear strip and pull tab. In many of these patents, the tear strip is loosely pulled back and the pull tab and tear strip are simply draped over the sides of the can. Thus the user who drinks from the dam is exposed to the raw edges of the tear strip.

Still another existing problem is the jagged sawtooth edge found on existing score line patterns. This problem is not readily observable although one can feel that a problem exists. This problem exists because of the tendency for a tear to follow first one side of the bottom of a score line and then to switch to the other side. This zigzag rupture pattern produces sharp sawtooth like edges at the bottom of the score pattern which will quite easily cut the user's tongue or lips.

Finally, the prior art easy open can ends have been plagued almost from the start by leading rivets caused by cracking in the region of the rivet because of the extremely severe stresses encountered in forming a rivet from a single thickness of metal.

SUMMARY OF THE PRESENT INVENTION

In the practice of the present invention all of the previously noted problems are effectively overcome. In particular, the easy open can end of the present invention does not push in a portion of the can end so as to contaminate the liquid contents of the container in that manner. Secondly, the present invention provides for an interlocking of a tear strip portion and a pull tab whereby the two remain tightly entwined at a predetermined position on the can end. The problem of unsanitary can ends is dealt with effectively by the use of a bio-degradable sanitary cover for the tear strip which is wound up and interlocked with the tear strip and the pull tab in the opening operation.

The present invention also contains a solution to the cut lip problem which results from a sawtooth edge left along the edge of the score line by rounding or chamfering one of the bottom edges of the score pattern to insure that tearing always occurs on the opposite bottom edge which is maintained sharp.

Finally, the present invention provides a solution to leakers by forming the connection of the pull tab from a double thickness of metal. Thus is becomes necessary for the cracks in the two thicknesses of metal to be in substantial alignment before leakage will occur.

One final advantage produced by the can end construction of the present invention is that the pull tab can be made of a more simple construction and narrower, for example, than the tabs in the previously mentioned Cudzik patents. In addition, the tab can be made from the same aluminum alloy as the aluminum alloy of the can itself. This is not true with respect to the Cudzik patents, and this makes a good recycling feature for the cans and can ends of the present invention.

The inherent advantages and improvements of the present invention will become more readily apparent upon reference to the following detailed discussion of the invention and by reference to the drawings wherein.

Figure 1:
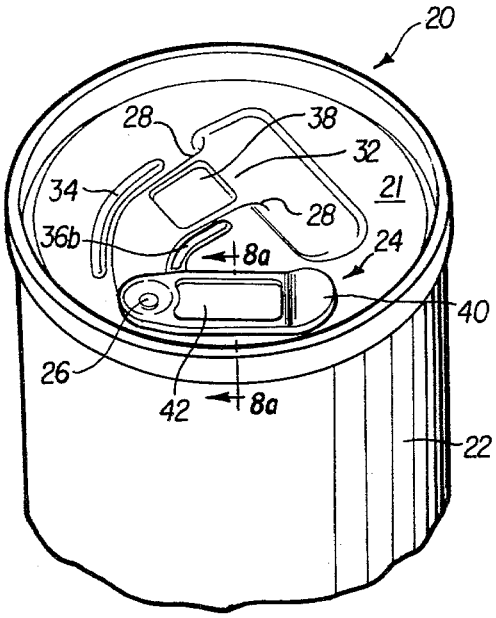
FIG. 1 is a fragmentary perspective view showing the easy open can end construction of the present invention.
Figure 2:
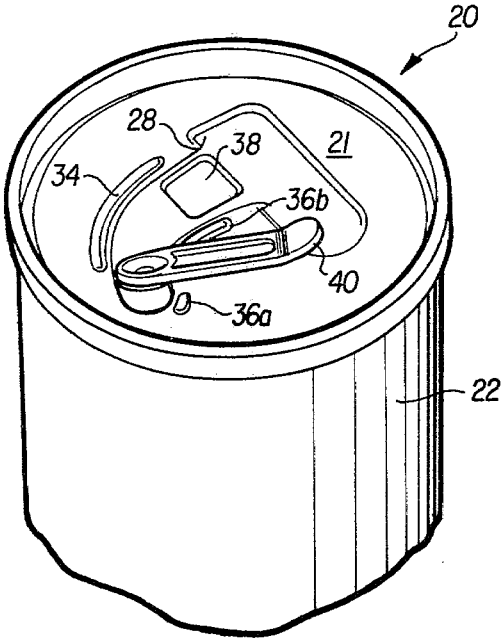
FIG. 2 is a fragmentary perspective view similar to FIG. 1 but showing the easy open can end partially open.
Figure 5:
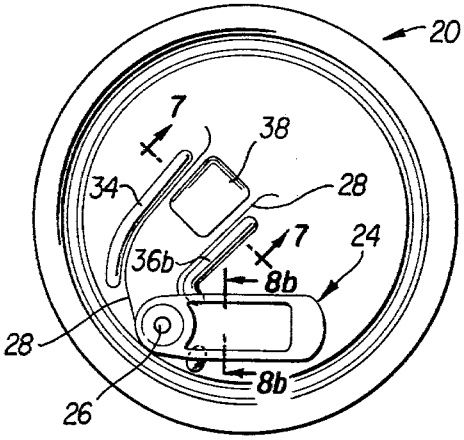
FIG. 5 is a top plan view showing a modified form of the present invention.
Figure 8A:
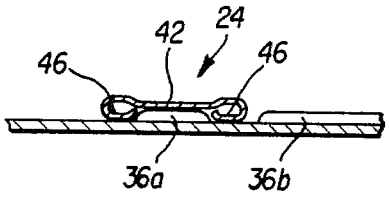
Figure 8B:
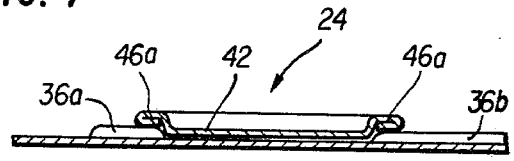
Figure 9:
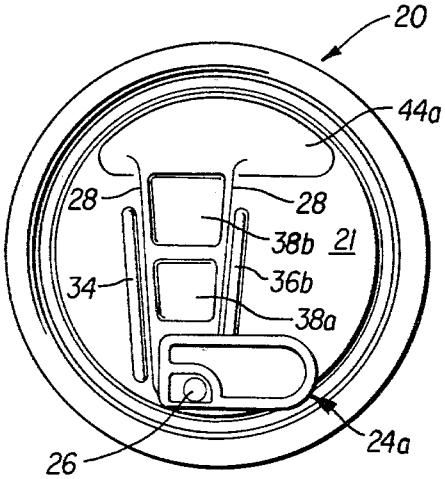
Figure 10:
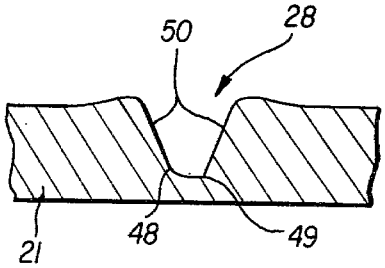
Figure 11:
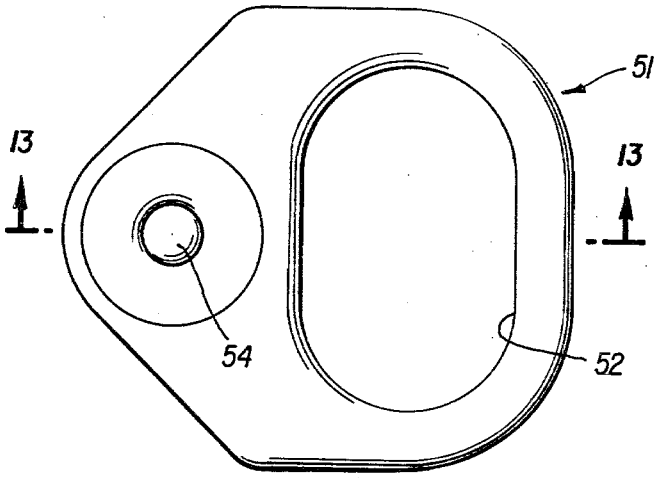
Figure 12:
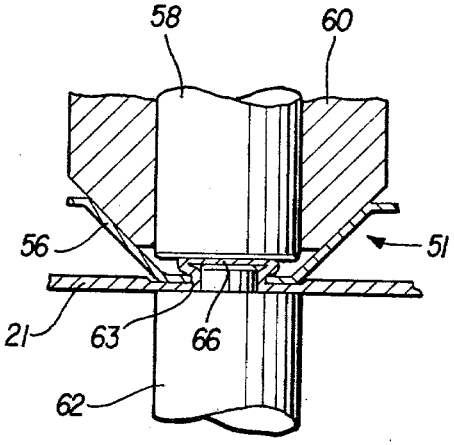
PRIOR ART FIG. 12
Figure 13:
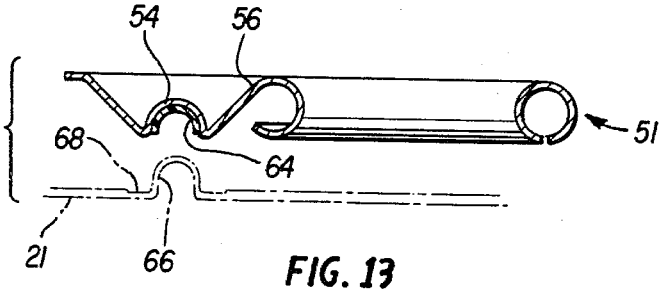
Figure 14:
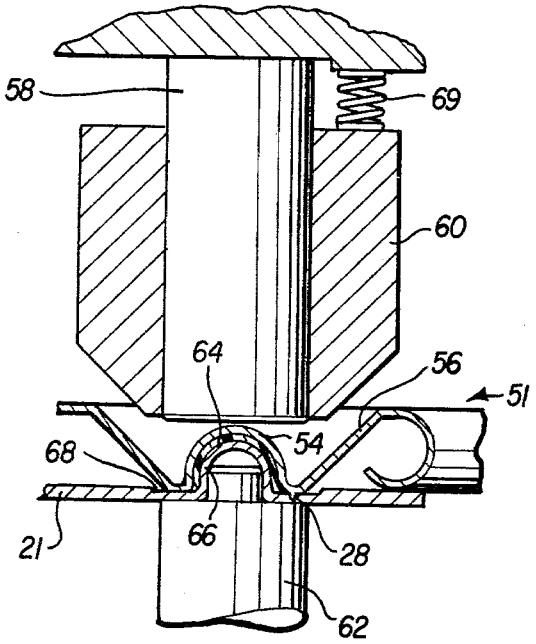
Figure 15:
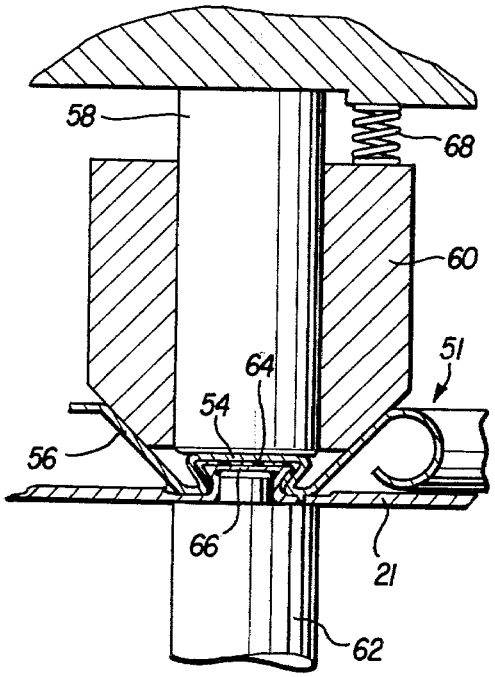
Figure 16:
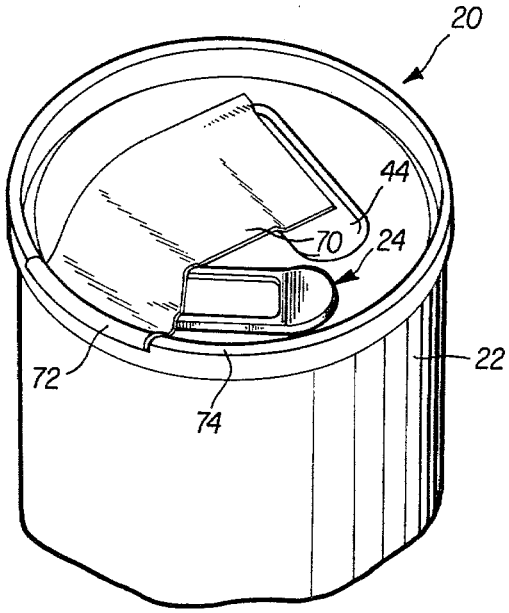

FIG. 8*a* is a fragmentary elevational view of the pull tab and can end taken in vertical cross section along line 8*a*—8*a* of FIG. 1;

FIG. 8*b* is a fragmentary elevational view of the pull tab and can end taken in vertical cross section along line 8*b*—8*b* of FIG. 5;

FIG. 9 is a top plan view showing another modification of the present invention;

FIG. 10 is a fragmentary elevational view, drawn to an enlarged scale, and taken in vertical cross section of a score line used in the present invention;

FIG. 11 is a top plan view of a pull tab for use in being riveted to the can end in accordance with the present invention;

FIG. 12 is a fragmentary elevational view, taken in vertical cross section, illustrating a prior art method of riveting a pull tab to a can end;

FIG. 13 is an elevational view of the pull tab of FIG. 11 taken in vertical cross section along line 13—13 and showing its relationship to a can end shown in phantom prior to riveting;

FIG. 14 is a fragmentary elevational view, taken in vertical cross section, showing riveting apparatus prior to formation of a rivet;

FIG. 15 is an elevational view, taken in vertical cross section, similar to FIG. 14 but showing the formation of the rivet; and FIGS. 16–19 are fragmentary perspective views of a modified form of the present invention illustrating progressive stages of opening of an easy open can end having a sanitary cover over the drinking area.

DETAILED DESCRIPTION OF THE INVENTION

Referring now to FIG. 1 of the drawings, an easy open can end is indicated generally at 20 which has a substantially flat central panel 21. The attachment of the can end 20 to a can body 22 is shown in each of FIGS. 1–4. The easy open can end is shown to have a pull tab, indicated generally at 24, with a conventional rivet 26 or other suitable attachment of the pull tab 24 to the flat central panel 21. A score line pattern is defined by score lines 28 which are generally parallel and as shown in FIGS. 1–4 preferably curved. The score line pattern is further defined by having the score lines joined at one end 30 and open at the opposite end 32 whereby upon lifting of the score line pattern from the plane of the central panel 21, the tab and score line pattern remain attached to the can end.

A first upstanding bead member is shown at 34 which follows the intermediate contour of the left side score line 28 while along the opposite or right side score line 28 a discontinuous bead line is formed from a pair of upstanding bead members at 36*a*, FIGS. 2–4, and 36*b*. The bead members 36*a*, 36*b* perform two principal functions. First of all, they cooperate with the opposed upstanding bead member 34 in providing lip protection along the exposed edge of the score pattern when the score pattern is fully removed from the central panel 21 as in the position shown in FIG. 4 and, secondly, the bead members 36*a*, 36*b* serve to orient the pull tab 24 at a location substantially perpendicular to the score line pattern in a manner which will become more evident hereinafter.

Figure 3:
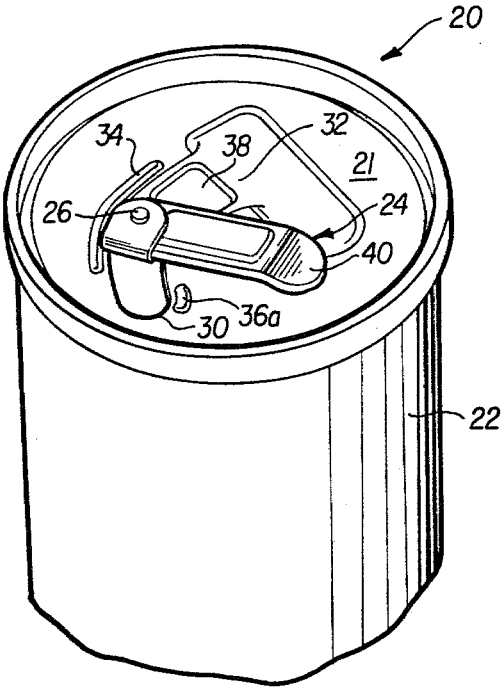
FIG. 3 is a fragmentary perspective view similar to FIG. 1 but showing the easy open can end at a stage of opening subsequent to FIG. 2.
Figure 4:
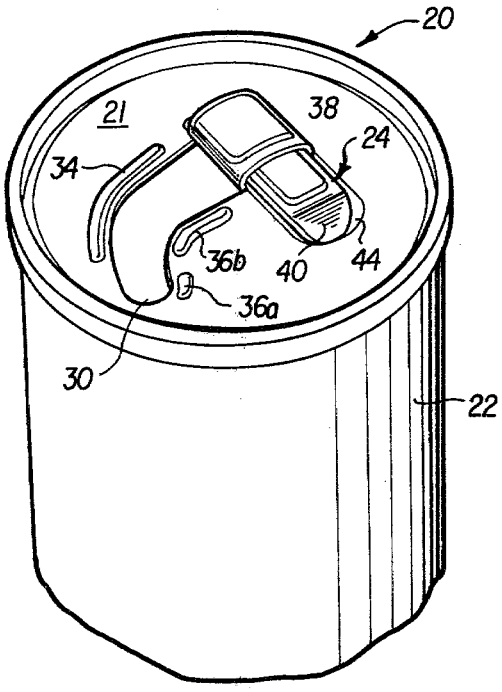
FIG. 4 is a fragmentary perspective view similar to FIG. 1 but showing the easy open end fully open.
Figure 7:
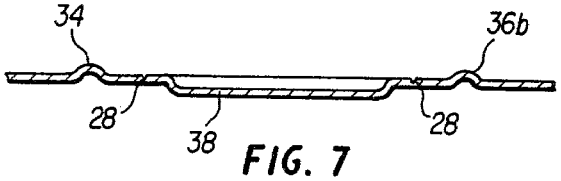
FIG. 7 is a fragmentary elevational view of the can end taken in vertical cross section along line 7—7 of FIG. 5.

In addtion to the use of opposed bead members to provide lip protection, a smooth surface abutment means 38 is provided as an additional protection for the face of the user by forming a recessed area within the score line pattern itself. The smooth surface abutment means 38 is so positioned with respect to the width of the pull tab 24 and the location of the rivet or other attachment 26 of the pull tab to the central panel 21 that after lifting the pull tab by means of an upturned end 40 in the manner illustrated in FIG. 2, the pull tab may then be twisted in the direction of the score line pattern as is illustrated in FIG. 3 for a predetermined number of half turns until the pull tab and interlocked tear strip portion is received within a recessed area 44. In the embodiment shown in FIGS. 1–4, the pull tab 24 after being lifted is then twisted for one and a half turns or three half revolutions to reach the position shown in FIG. 4. In order to have the pull tab 24 and the interlocked tear strip portion lie substantially flat within the recessed area 44, its width is made at least ten times as great as its thickness. In the position shown in FIG. 4, the smooth surface abutment means 38 is positioned on top of the torn out portion of the tear strip so as to guard the user's face from contact with the raw edge of the interlocking portion of the tear strip. FIG. 7 shows an elevational view of the beads 34 and 36*b* as well as abutment means 38. It will be recognized that the score lines 28 permit severence of the score pattern and inversion of the abutment means 38 to protect the upper lip and nose of the user. Similarly, the upstanding beads 24 on one side of the removed portion of the tear strip and beads 36*a*, 36*b* on the other side provide protection from the raw edge of the score line 28.

One means for orienting the pull tab 24 with respect to the score line pattern is illustrated in FIG. 8*a*. In this figure, the pull tab 24 is shown to have a slightly depressed central panel 42 and curled edge flanges 46. The spacing between bead members 36*a*, 36*b* is such as to closely receive a curled edge flange 46 nearest the center of the flat central panel 21 and the length of bead member 36*a* is such as to be received beneath the depressed central panel 42 and to locate the opposed curled edge flanges 46 properly.

Figure 6:
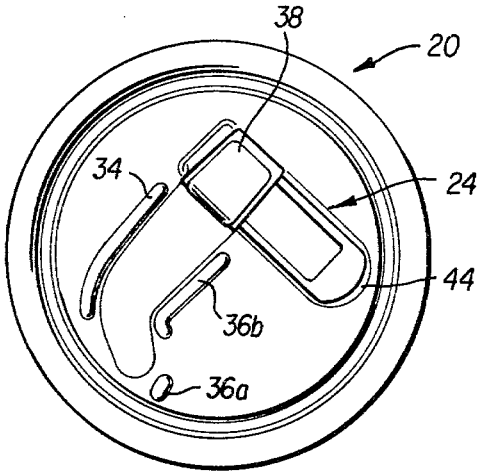
FIG. 6 is a top plan view similar to FIG. 5 with the easy open can end fully open.

FIGS. 5 and 6 in combination with FIG. 8*b* show another means for orienting the pull tab 24 with respect to the score pattern. In this figure, the pull tab is again removed by lifting and twisting for one and one half revolutions, or three half turns, so that the pull tab and attached tear strip are moved from the FIG. 5 position into the FIG. 6 position. Prior to opening, the pull tab 24 is held in place substantially at right angles to the curved score pattern by means of being positioned between the spacing provided for by bead members 36*a*, 36*b* which closely abut the fully depressed central panel 42 in the manner illustrated in FIG. 8*b* with opposed hemmed edges 46*a* resting atop the bead members 36*a*, 36*b*.

A further modification of the invention is illustrated in FIG. 9. In this figure, a pull tab indicated at 24*a* is attached to the can body by means of rivet 26 or other suitable means of attachment to the flat central panel 21 of the can end 20. In this figure, upstanding bead members 34, 36*a* (not shown) and 36*b* follow the contour of score lines 28 which are closed at one end beneath pull tab 24*a* and open at the opposite end. In this embodiment, two smooth surface abutment means 38*a* and 38*b* are disposed in series within the score line pattern. After lifting to pop the score 28, the pull tab 24*a* is twisted in the direction of the score line pattern toward the open end thereof. One complete revolution of the pull tab exposes the smooth surface abutment means 38*a* and one and a half revolutions of the pull tab 24*a* exposes the second smooth surface abutment means 38*b* atop the wound up score line at the pull tab to guard the face of the user against contact with the edge of the score line pattern as in the previous embodiment. Thus in this embodiment, the user has the option of partial opening or full opening of the score line pattern depending upon the desired usage.

Referring now to FIG. 10, an enlarged view of a single score line is illustrated. The score line is indicated generally at 28 in this figure and is shown to be impressed within a substantially flat central panel 21. The score line 28 has a rounded edge 48 and a sharp edge 49 at the bottom of downwardly and inwardly sloping side walls 50. The rounded edge 48 is rounded sufficiently so that tearing occurs along the opposite edge 49. A radius of from 0.001 inches through 0.003 inches for the rounded edge 48 has been found to be satisfactory while maintaining a sharp edge 49 by having a much smaller radius such as a radius of about 0.0002 inches on the scoring tool. Alternatively, the edge 48 may be chamferred. A chamfer of from 0.004 through 0.003 inches on a 45 degree chamfer has been found to be satisfactory while maintaining the same sharp edge at 49 as described previously. By making the score line 28 in this manner, the rupture occurs along edge 49 and does not zigzag from one side to the other. Therefore, the jagged edge heretofore encountered is eliminated.

Referring now to FIGS. 11–15, there will be described a method of forming a rivet for the easy-open metallic can end in which a rivet is formed from two metal thicknesses rather than from a single metal thickness as in the prior art. In the formation of prior art rivets, it has been known to form the metal from the central panel progressively from a relatively large diameter area and gradually confining the formed metal to a small diameter nipple. Thus it has been known to form an initial large diameter downwardly extending bubble in the flat central panel 21, then reversing the bubble by forming the bubble into an upstanding nipple of reduced diameter followed by a further shaping of the nipple. The embossing and debossing of the can end is then accomplished to form upstanding bead members such as 34, 36*a*, 36*b* as well as a depression for the recessed area 44. A score pattern for the opening strip is then placed on the central panel and the tab is then assembled to the end. In this latter assembly operation such as is illustrated in FIG. 12, the tab 51 is illustrated to have a cone shaped area surrounding an aperture 63. A top riveting tool is shown at 58 bordered by tab holding members 60 which may be spring loaded to engage a cone-shaped portion 56 of the ring pull tab 51. It should be observed that while FIGS. 11–15 illustrate a ring pull tab, that the technique is applicable to pull the tabs generally. The prior art is shown to use a bottom riveting tool 62 which extends through the hole in pull tab 51. A single thickness of metal is thereby formed at 66 which locks the ring pull tab 51 or other pull tab to the flat central panel 21. A major rejection of finished easy-open can ends occurs because the rivet ruptures in a plane substantially coincident with and in a radial direction from the top of the bottom riveting tool 62.

In the improved double thickness rivet, the same technique that is used to form the nipple 66 in the prior art can end is also employed to make a corresponding nipple 54 in the pull tab as illustrated in FIG. 13. A sealant or gasketing material 64 may be employed to be positioned between the underside of nipple 54 and the conventionally formed nipple 66 to seal against possible leakers. FIG. 14 shows the formed tab 51 in position over the flat central panel 21 located with the aid of annular depression 68 which surrounds the nipple 66. A top riveting tool 58 having tab holding members 60 spring loaded at 69 is again urged toward the pull tab 51 thus located on the can end central panel 21 and having a nipple 66 supported on a bottom riveting tool 62 so as to form the rivet of double thickness, that is, metal thicknesses 54 and 66 in FIG. 15. Thus, any comparable cracking of the rivet in the outer peripheral portion will require that both thicknesses of metal 54, 66 be cracked in substantially the same location in order for liquid within the container to leak therefrom.

Referring now to FIGS. 16–19, there will be described a further embodiment of the invention wherein a sanitary cover 70 is used to insure a sanitary drinking area on the container from which the consumer may drink. To this end, the sanitary cover 70 made by coated paper or plastic material, preferably bio-degradable, is suitably adhered to the end of the tab to cover the drinking area. The sanitary cover 70 has a chime covering portion 72 for the chime 74 of the container.

Figure 17:
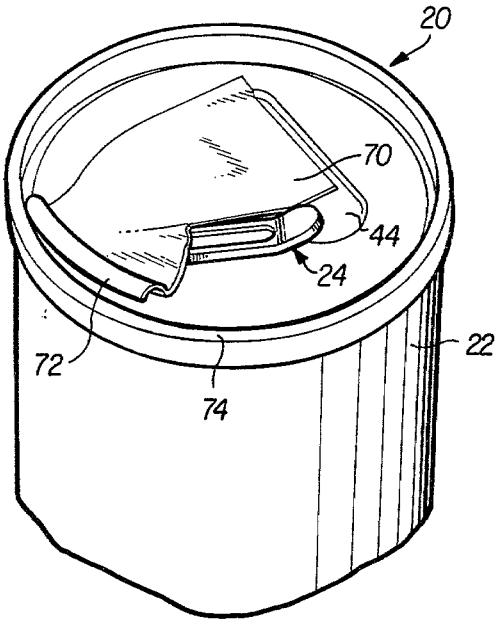
Figure 18:
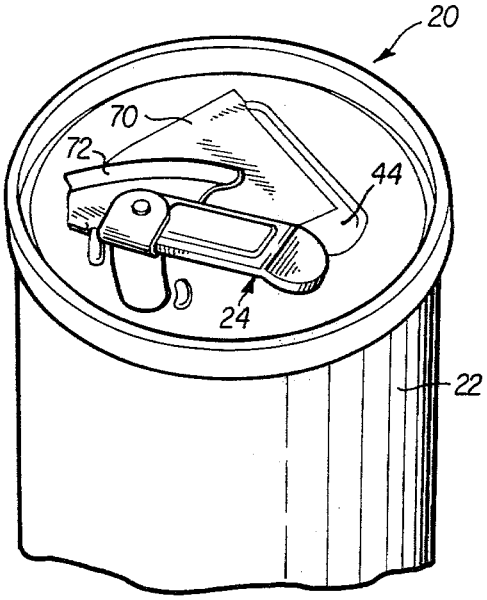
Figure 19:
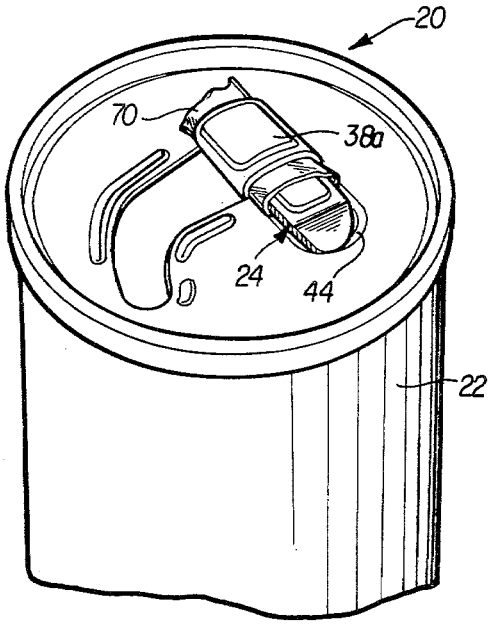

FIG. 17 illustrates the first step in the opening operation in which a pull tab 24 is lifted and then twisted as illustrated in FIG. 18 until it reaches its final position shown in FIG. 19 in which the sanitary cover is rolled up and interlocked between the pull tab and the tear strip. In this embodiment, a smooth surface abutment means 38*a* is exposed to protect the face of the user. The pull tab and tear strip with interlocked sanitary cover 70 dwell within a recessed area 44 on the container after a given number of half revolutions of the pull tab 24, such as three half revolutions.

A number of modifications may be made in the invention without departing from the spirir or scope thereof. For example, in place of utilizing hemmed or rolled edges for the pull tab, the latter may be oriented with one or more protrusions or beads on the can end which engage the side edges of the pull tab. Another possible arrangement is to use depressions in the can end into which a rolled edge 46 on one or both sides as illustrated in FIG. 8*a* would be lodged. Also the sanitary cover 72 may be made of different sizes and may cover more area than that shown in FIGS. 16–19, if desired.

While presently preferred embodiments of the invention have been illustrated and described, it will be recognized that the invention may be otherwise variously embodied and practiced within the scope of the claims which follow.

What is claimed is:

1. An easy open can end construction for metallic beverage cans which comprises:

a. a can end having a substantially flat central panel, b. a pair of generally parallel score lines defining a tear strip in said flat central panel with said score lines being closed at one end and open at the opposite end, c. a pull tab secured to said flat central panel within said pair of score lines adjacent the closed end thereof, (1) said pull tab having a substantially flat body portion whose width is at least ten times its height, (2) said pull tab having its longitudinal axis positioned at substantially right angles to the longitudinal axis of said parallel score lines, (3) first orienting means on pull tab for maintaining the position of said pull tab with respect to said parallel score lines prior to opening the can end, (4) second orienting means on said can end cooperating with said first orienting means on said pull tab for maintaining the position of said pull tab with respect to said parallel score lines, d. said can end adapted to be opened by pivotal movement of said pull tab in a direction substantially at right angles to said score lines and then twisting for a given number of half turns in the direction of the score lines whereby said pull tab becomes interlocked with said tear strip and lies closely adjacent the central panel so as not to interfere with the nose of the user should the user drink directly from the can.

2. An easy open can end construction as defined in claim 1 including smooth surface means extending upwardly out of the plane of said substantially flat central panel serving as a guard means to prevent the face of the user from contacting the raw edge along the score lines after opening the can end.

3. An easy open can end construction as defined in claim 2 wherein said smooth surface means comprise upstanding bead members extending generally parallel to and exteriorly of said score lines.

4. An easy open can end construction as defined in claim 3 wherein one of said bead members is interrupted to define the orienting means for maintaining the position of said pull tab with respect to said parallel score lines prior to opening the can end.

5. An easy open can end construction as defined in claim 4 wherein said first orienting means on said pull tab consists of a rolled over edge which is positioned to dwell within the interruption of one of said bead members to maintain the position of said pull tab with respect to said parallel score lines prior to opening the can end.

6. An easy open can end construction as defined in claim 1 wherein said flat central panel includes smooth surface abutment means positioned within said tear strip which project downwardly therefrom but which upon twisting of said pull tab for a given number of half turns during the opening operation become repositioned to project upwardly from the tear strip to guard the face of the user from the raw metallic edge of the tear strip.

7. An easy open can end construction as defined in claim 6 which includes a plurality of smooth surface abutment means sequentially positioned within said tear strip and which become selectively repositioned to project upwardly from the tear strip upon twisting a different number of half turns of said pull tab to guard the face of the user from the raw metallic edge of the tear strip.

8. An easy open can end construction as defined in claim 6 wherein said substantially flat panel member is provided with a depressed well area into which extends said interlocked pull tab and tear strip extend upon twisting said pull tab a given number of half turns.

9. An easy open can end construction as defined in claim 6 wherein said generally parallel score lines intermediate their ends follow a generally arcuate path and said pull tab extends transversely away from said score lines in a direction toward the centers of curvature of said score lines.

10. An easy open can end construction as defined in claim 6 including smooth surface means extending upwardly out of the plane of said substantially flat central panel serving as a guard means to prevent the face of the user from contacting the raw edge along the score lines after opening the can end.

11. An easy open can end construction as defined in claim 10 wherein said smooth surface means comprise upstanding bead members extending generally parallel to and exteriorly of said score lines.

12. An easy open can end construction as defined in claim 11 wherein one of said bead members is interrupted to define the orienting means for maintaining the position of said pull tab with respect to said parallel score lines prior to opening the can end.

13. An easy open can end construction as defined in claim 12 wherein said first orienting means on said pull tab consists of a rolled over edge which is positioned to dwell within the interruption of one of said bead members to maintain the position of said pull tab with respect to said parallel score lines prior to opening the can end.

14. An easy open can end construction as defined in claim 1 including a sanitary cover member overlying at least a portion of said flat central panel with said cover member being rolled up with said tab member and said tear strip and becoming interlocked therewith.

15. An easy open can end construction for metallic beverage cans which comprises:

a. a can end having a substantially flat central panel, b. a pair of generally parallel score lines defining a tear strip in said flat central panel with said score lines being closed at one end and open at the opposite end, c. a pull tab secured to said flat central panel within said pair of score lines adjacent the closed end thereof, (1) said pull tab having a substantially flat body portion whose width is at least ten times its height, (2) said pull tab having its longitudinal axis positioned at substantially right angles to the longitudinal axis of said parallel score lines, d. said can end adapted to be opened by pivotal movement of said pull tab in a direction substantially at right angles to said score lines and then twisting for a given number of half turns in the direction of the score lines whereby said pull tab becomes interlocked with said tear strip and lies closely adjacent the central panel so as not to interfere with the nose of the user should the user drink directly from the can.

16. An easy open can end construction as defined in claim 15 including smooth surface means extending upwardly out of the plane of said substantially flat central panel serving as a guard means to prevent the face of the user from contacting the raw edge along the score lines after opening the can end.

17. An easy open can end construction as defined in claim 15 wherein said flat central panel includes smooth surface abutment means positioned within said tear strip which project downwardly therefrom but which upon twisting of said pull tab for a given number of half turns during the opening operation become repositioned to project upwardly from the tear strip to guard the face of the user from the raw metallic edge of the tear strip.

18. An easy open can end construction as defined in claim 15 wherein said substantially flat panel member is provided with a depressed well area into which extends said interlocked pull tab and tear strip extend upon twisting said pull tab a given number of half turns.

19. An easy open can end construction as defined in claim 15 wherein said generally parallel score lines intermediate their ends follow a generally arcuate path and said pull tab extends transversely away from said score lines in a direction toward the centers of curvature of said score lines.

20. An easy open can end construction as defined in claim 15 including a sanitary cover member overlying at least a portion of said flat central panel with said cover member being rolled up with said tab member and said tear strip and becoming interlocked therewith.

* * * * *